US009254666B2

(12) United States Patent
Kimura et al.

(10) Patent No.: US 9,254,666 B2
(45) Date of Patent: Feb. 9, 2016

(54) LIQUID EJECTING APPARATUS

(71) Applicant: SEIKO EPSON CORPORATION, Tokyo (JP)

(72) Inventors: Naomi Kimura, Okaya (JP); Koki Hayashi, Suwa (JP); Hidenao Suzuki, Shiojiri (JP); Shoma Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/566,508

(22) Filed: Dec. 10, 2014

(65) Prior Publication Data

US 2015/0174907 A1 Jun. 25, 2015

(30) Foreign Application Priority Data

Dec. 19, 2013 (JP) ..... 2013-262146

(51) Int. Cl.
*B41J 2/175* (2006.01)

(52) U.S. Cl.
CPC ..... *B41J 2/175* (2013.01)

(58) Field of Classification Search
CPC ..... B41J 2/175
See application file for complete search history.

(56) References Cited

U.S. PATENT DOCUMENTS

| | | | | |
|---|---|---|---|---|
| 5,367,328 | A * | 11/1994 | Erickson | 347/7 |
| 5,686,947 | A * | 11/1997 | Murray et al. | 347/85 |
| 6,174,055 | B1 * | 1/2001 | Sugikubo et al. | 347/89 |
| 6,409,322 | B1 * | 6/2002 | Ishitsu et al. | 347/85 |
| 6,679,587 | B2 * | 1/2004 | Chen et al. | 347/63 |
| 2005/0083382 | A1 * | 4/2005 | Shiho et al. | 347/85 |
| 2006/0256169 | A1 * | 11/2006 | Kobayashi et al. | 347/85 |
| 2012/0062648 | A1 * | 3/2012 | Tanaka | B41J 19/00 347/37 |

FOREIGN PATENT DOCUMENTS

JP 2012-152995 8/2012

* cited by examiner

*Primary Examiner* — Stephen Meier
*Assistant Examiner* — John P Zimmermann
(74) *Attorney, Agent, or Firm* — Workman Nydegger

(57) ABSTRACT

Provided is a liquid ejecting apparatus which includes a carriage which reciprocates in a state where a liquid ejecting head is mounted thereon, a tank unit which is provided outside the carriage and accommodates ink, four liquid supply tubes which communicate with the liquid ejecting head and the tank unit, and a tube support portion which supports the liquid supply tubes in a state where the liquid supply tubes are aligned in a horizontal direction, in which, in a case main body, the liquid supply tubes extend further to the tank unit side than a portion in which the liquid supply tubes are supported by the tube support portion, in a state where a parallel alignment direction of the four liquid supply tubes changes from the horizontal direction (a transporting direction) to a vertical direction.

9 Claims, 10 Drawing Sheets

LIQUID EJECTING APPARATUS

BACKGROUND

1. Technical Field

The present invention relates to a liquid ejecting apparatus.

2. Related Art

In a certain type of a liquid ejecting apparatus which forms an image in such a manner that a carriage having a liquid ejecting head mounted thereon reciprocates and ink is ejected onto a recording medium, such as a paper sheet, an ink tank is provided outside the carriage and a liquid supply tube is provided to supply ink from the ink tank to the liquid ejecting head.

In an ink jet recording apparatus disclosed in, for example, JP-A-2012-152995, a tank unit accommodating an ink tank having ink stored therein is provided in a lateral surface side of an apparatus main body and the ink is supplied to a liquid ejecting head through a liquid supply tube. Downstream-side end portions of a plurality of liquid supply tubes in the apparatus main body are fixed to a carriage and are deformed in accordance with reciprocation of the carriage. Upstream sides of the liquid supply tubes are supported by a supporting portion extending in a movement direction of the carriage. Parts of the liquid supply tubes, which are portions extending further to the upstream side than the supporting portion, pass through an opening portion in a lateral surface of the apparatus main body and are disposed on the tank unit side.

Accordingly, in the apparatus main body, a spatial area is provided in a portion between the supporting portion and the opening portion, to allow the liquid supply tubes to be disposed therein. The liquid supply tubes are disposed in the spatial area. In addition, a spatial area is provided in a portion between the lateral surface of the apparatus main body and the tank unit, to allow the liquid supply tubes to be disposed therein.

However, when the spatial area is provided in the portion between the supporting portion and the opening portion in the apparatus main body, to allow the liquid supply tubes to be disposed therein, there is a problem in that the apparatus main body increases in width, height, and depth dimension and the size of the apparatus main body increases. Furthermore, when the spatial area is provided in the portion between the lateral surface of the apparatus main body and the tank unit, to allow the liquid supply tubes to be disposed therein, there is a problem in that the installation area of both the apparatus main body and the tank unit increases.

SUMMARY

The invention can be realized in the following forms or application examples.

APPLICATION EXAMPLE 1

According to this application example, there is provided a liquid ejecting apparatus including a carriage which reciprocates in a state where a liquid ejecting head for ejecting liquid is mounted thereon, liquid accommodation portions which accommodate the liquid, a plurality of liquid supply tubes which communicate with the liquid ejecting head and the liquid accommodation portions and supply the liquid from the liquid accommodation portions to the liquid ejecting head, a tube support portion which supports the plurality of liquid supply tubes in a state where the liquid supply tubes are aligned in a horizontal direction, and a case which accommodates the carriage and the tube support portion, in which a plurality of the liquid accommodation portions are arranged in the lateral side of the case. Furthermore, in the case, the plurality of liquid supply tubes extend further to the liquid accommodation portion side than a portion in which the liquid supply tubes are supported by the tube support portion, in a state where a parallel alignment direction of the plurality of liquid supply tubes changes from the horizontal direction to a vertical direction such that the liquid supply tubes extend in an alignment direction of the plurality of liquid accommodation portions.

In this configuration, in the case, the plurality of liquid supply tubes extend further to the liquid accommodation portion side that the portion in which the liquid supply tubes are supported by the tube support portion, in a state where the parallel alignment direction of the plurality of liquid supply tubes changes from the horizontal direction to the vertical direction. Thus, it is possible to reduce the length of a spatial area in the horizontal direction, which is provided in the case to allow the liquid supply tubes to be disposed therein. As a result, the case can be prevented from increasing in size. The lateral side of the case may be the front side or the rear side.

APPLICATION EXAMPLE 2

The liquid ejecting apparatus further includes a curved wall portion which stands in the vertical direction and has a curved cross-sectional shape, when viewed from the vertical direction. In addition, the curved wall portion changes the parallel alignment direction of the plurality of liquid supply tubes, from the horizontal direction to the vertical direction.

In this configuration, the liquid supply tubes can be arranged along the curved wall portion, the extending direction of the liquid supply tubes can be changed along the curved shape and the liquid supply tubes can be prevented from being damaged.

APPLICATION EXAMPLE 3

In the liquid ejecting apparatus according to the application example, the curved wall portion has a curved surface and the curved surface is located further to the front side of the case than the central position of the tube support portion in the parallel alignment direction of the liquid supply tubes.

In this configuration, the curved surface is located further to the front side of the case than the tube support portion. Thus, the parallel alignment direction of the liquid supply tubes can be easily changed from the horizontal direction to the vertical direction. The front side of the case indicates a paper-discharging direction side and the rear side is a paper-feeding direction side.

APPLICATION EXAMPLE 4

In the liquid ejecting apparatus according to the application example, the liquid supply tube is disposed in a portion between the curved wall portion and an inner wall portion of the case.

In this configuration, the movement of the liquid supply tubes is regulated. As a result, unevenness or rattling of the liquid supply tubes can be prevented.

APPLICATION EXAMPLE 5

In the liquid ejecting apparatus according to the application example, a main body frame is provided in the case. Furthermore, the liquid accommodation portion has a storage portion for storing the liquid, a tank cover for accommodating the storage portion, and a mounting portion which is mounted on the main body frame, in a state where the mounting portion supports the storage portion and the tank cover. In addition, a rib is provided in the mounting portion to support the liquid supply tubes.

In this configuration, the liquid supply tubes in the mounting portion can be supported from below in the vertical direction.

APPLICATION EXAMPLE 6

In the liquid ejecting apparatus according to the application example, a tube holding portion is provided in the mounting portion to allow the liquid supply tubes to be held in a portion between the main body frame and the storage portion, in a state where the liquid supply tubes are stretched.

In this configuration, the distance between the case and the storage portion can be reduced. As a result, the installation area of both the case and the storage portion can be reduced.

APPLICATION EXAMPLE 7

In the liquid ejecting apparatus according to the application example, a protrusion portion and a first through-hole are provided in the mounting portion and a concave portion and a first screw hole are provided in the main body frame. Furthermore, the protrusion portion is inserted into the concave portion and the position of the mounting portion is set with respect to the main body frame. In addition, a screw passing through the first through-hole is screwed into the first screw hole and the mounting portion is fixed to the main body frame.

In this configuration, the mounting portion can be fixed to the main body frame.

APPLICATION EXAMPLE 8

In the liquid ejecting apparatus according to the application example, an engaging portion having a protrusion portion formed in a tip end portion is provided in the mounting portion and a second screw hole is provided in the case. Furthermore, an engaged portion engaging with the protrusion portion and a second through-hole are provided in the tank cover and the engaging portion engages with the engaged portion and the tank cover is fixed to the mounting portion. In addition, a screw passing through the second through-hole is screwed into the second screw hole and the tank cover is fixed to the case.

In this configuration, the tank cover can be fixed to both the mounting portion and the main body frame.

APPLICATION EXAMPLE 9

In the liquid ejecting apparatus according to the application example, an opening portion is provided in the tank cover to allow liquid to be poured therethrough.

In this configuration, a user can pour liquid into the storage portion, without opening the tank cover. As a result, it is not necessary to provide, outside the tank cover, a spatial area to allow the tank cover to be pivoted or slid, to open the tank cover.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

Hereinafter, an embodiment will be described with reference to the accompanying drawings. In the X-Y-Z orthogonal coordinate system used for illustration in each drawing, an X direction is a movement direction (a main scanning direction) of a carriage, a Y direction is a transporting direction (a sub-scanning direction) of a recording medium, and a Z direction is the gravity direction. The arrow direction in the Y direction indicates a downstream side in the transporting direction and the arrow direction in the Z direction indicates an upper side.

Figure 1:
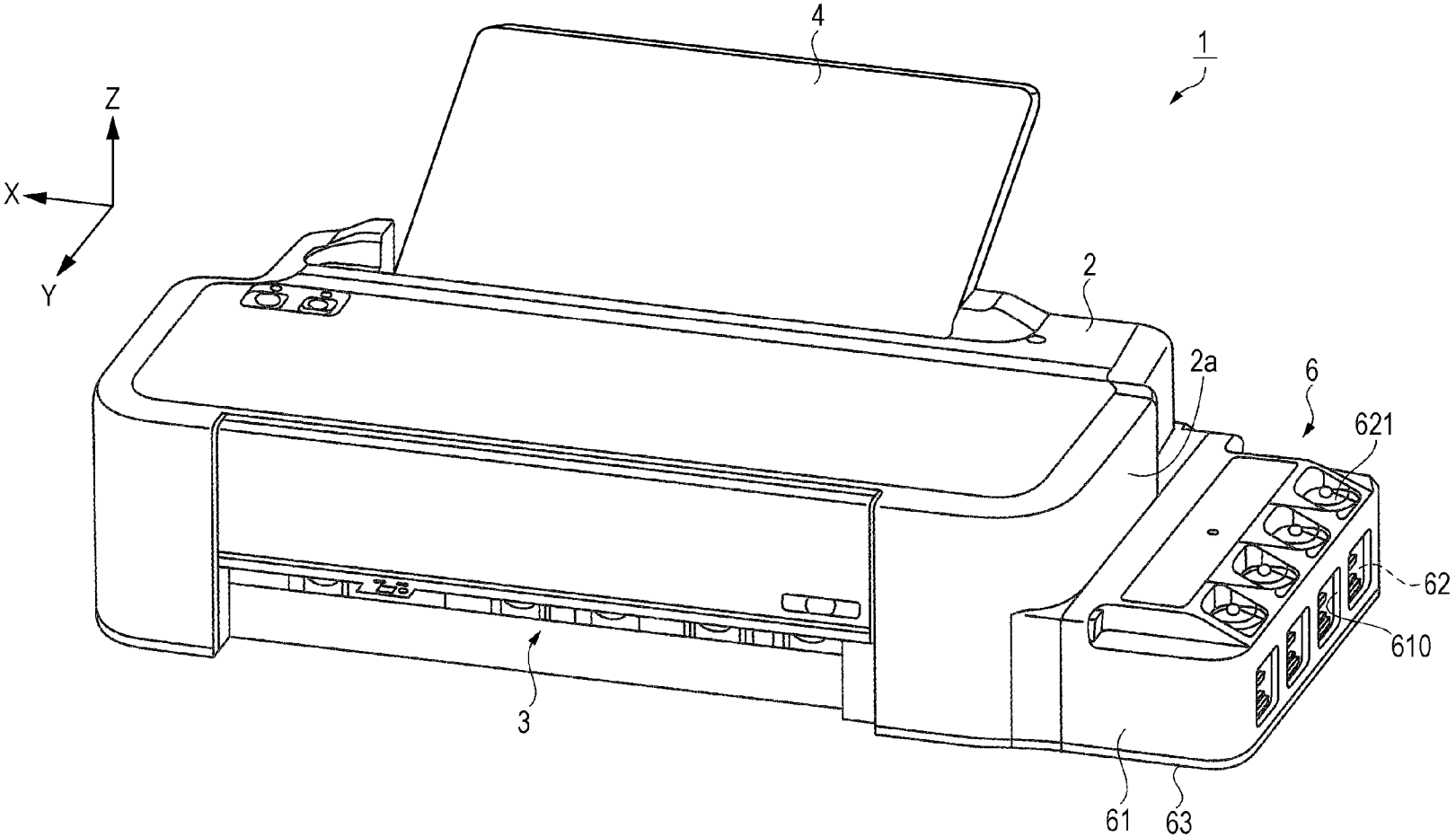
FIG. 1 is a perspective view of an appearance of an ink jet printer.

FIG. 1 is a perspective view of an appearance of an ink jet printer 1 (hereinafter, referred to as a "printer") as an example of a liquid ejecting apparatus, when seen from a front side. A paper support 4 is provided in a rear side of a case main body 2. The paper support 4 inclinedly supports a paper sheet (not illustrated) as an example of the recording medium. The paper sheets mounted on the paper support 4 are fed to the inner portion of the case main body 2 and are subjected to recording, and then the paper sheets are discharged through a discharge opening portion 3 provided on the front side.

Figure 2A:
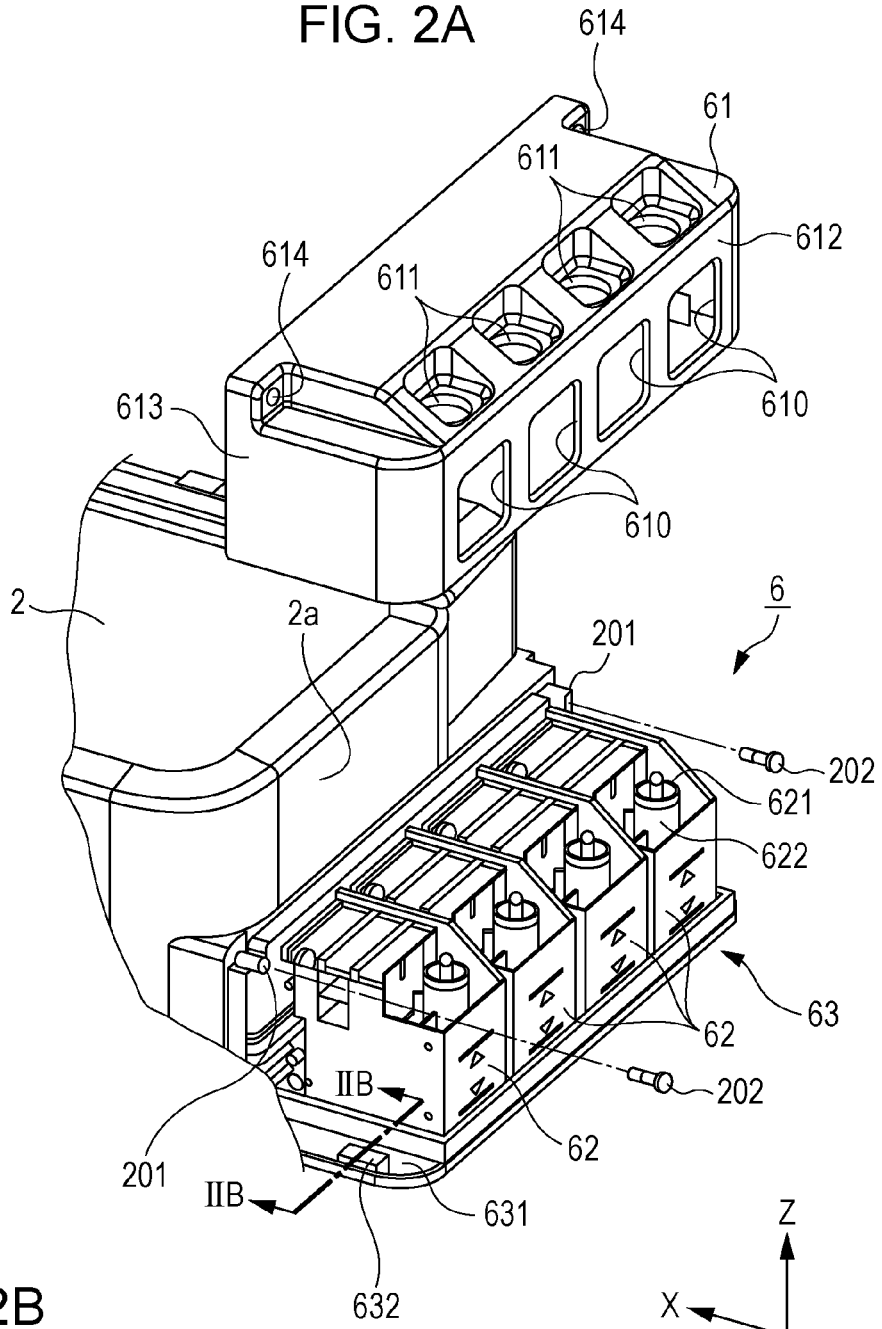
FIG. 2A is a perspective view illustrating a tank unit in a state where a tank cover is removed and FIG. 2B is a partial cross-sectional view taken along the line IIB-IIB in FIG. 2A.
Figure 2B:
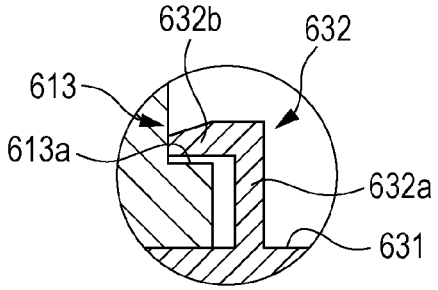

A tank unit 6 is provided in a lateral surface 2*a* of the case main body 2. FIG. 2A is a perspective view illustrating the tank unit 6 in a state where a tank cover 61 is removed and FIG. 2B is a partial cross-sectional view taken along the line IIB-IIB. The tank unit 6 has four ink tanks 62, a mounting portion 63 for supporting the ink tanks 62, and the tank cover 61. The tank cover 61 covers and accommodates the ink tanks 62.

Through-holes 614 are provided in both the front side and the rear side of an upper portion of the tank cover 61. The tank cover 61 illustrated in FIG. 1 is fixed to the case main body 2, in such a manner that a screw 202 passes through the through-hole 614 and is screwed into a screw hole 201 in the case main body 2.

An engaging portion 632 is provided in a bottom wall 631 of the mounting portion 63. FIG. 2B illustrates a cross-sectional surface of both the tank cover 61 of FIG. 1 and the mounting portion 63 in a state where the tank cover 61 is mounted on the mounting portion 63, when seen from the right side of FIG. 2A in the main scanning direction X, at the position indicated by the broken line IIB-IIB in the engaging portion 632 in FIG. 2A. The engaging portion 632 has a standing portion 632*a* and a protrusion portion 632*b*. The standing portion 632*a* stands upward from the bottom wall 631. The protrusion portion 632*b* horizontally protrudes from the upper end portion of the standing portion 632*a*.

The protrusion portion 632*b* engages with a stepped portion 613*a* which is provided in a bottom side of a front wall portion 613 of the tank cover 61. The engaging portion 632 having the same configuration is also provided in the rear side (see FIG. 7) of the mounting portion 63. In addition, a stepped portion (not illustrated) having the same configuration as that of the stepped portion 613*a* is also provided in the rear side of the tank cover 61. Accordingly, the tank cover 61 is fixed to the mounting portion 63, using the engaging portion 632 having the protrusion portion 632*b*.

A plurality of color inks (for example, inks of yellow, magenta, cyan, and black) are stored in the ink tanks 62. A visual checking portion 610 is provided in a lateral wall portion 612 of the tank cover 61. The amount of remaining ink in the ink tank 62 accommodated in the tank cover 61 can be visually checked, by a user, through the visual checking portion 610.

Both an ink pouring portion 622 and a cap 621 are provided in each ink tank 62. The ink pouring portion 622 has a cylindrical shape protruding upward. The cap 621 can seal the ink pouring portion 622. In addition, an opening portion 611 is formed in the upper portion of the tank cover 61. Both the ink pouring portion 622 and the cap 621 pass through the opening portion 611.

Accordingly, in a state where the tank cover 61 illustrated in FIG. 1 is fixed to both the case main body 2 and the mounting portion 63, a user can pour ink through the ink pouring portion 622, without removing the tank cover 61.

Figure 3:
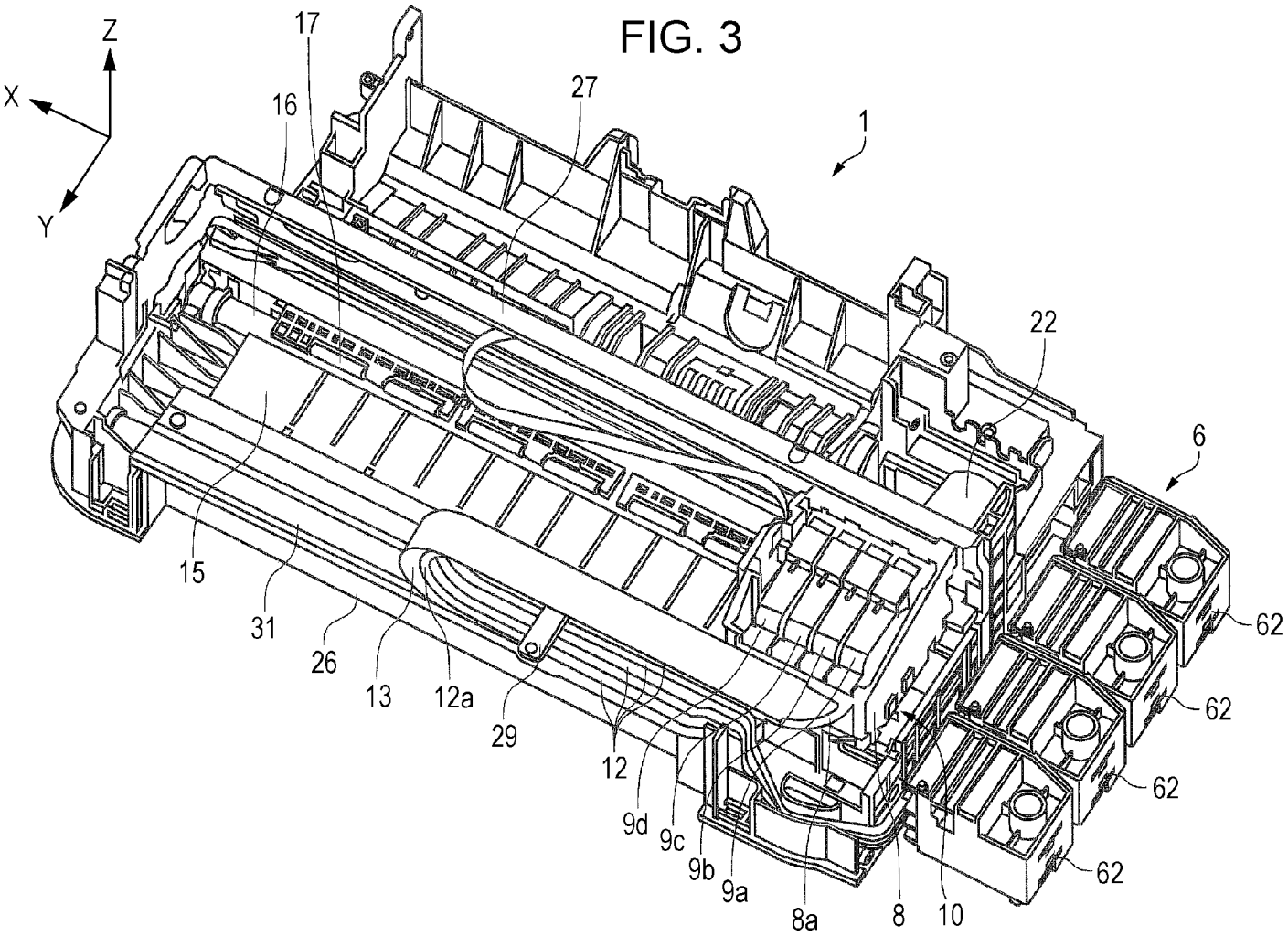
FIG. 3 is a perspective view illustrating the ink jet printer in a state where a case main body and the tank cover are removed.
Figure 4:
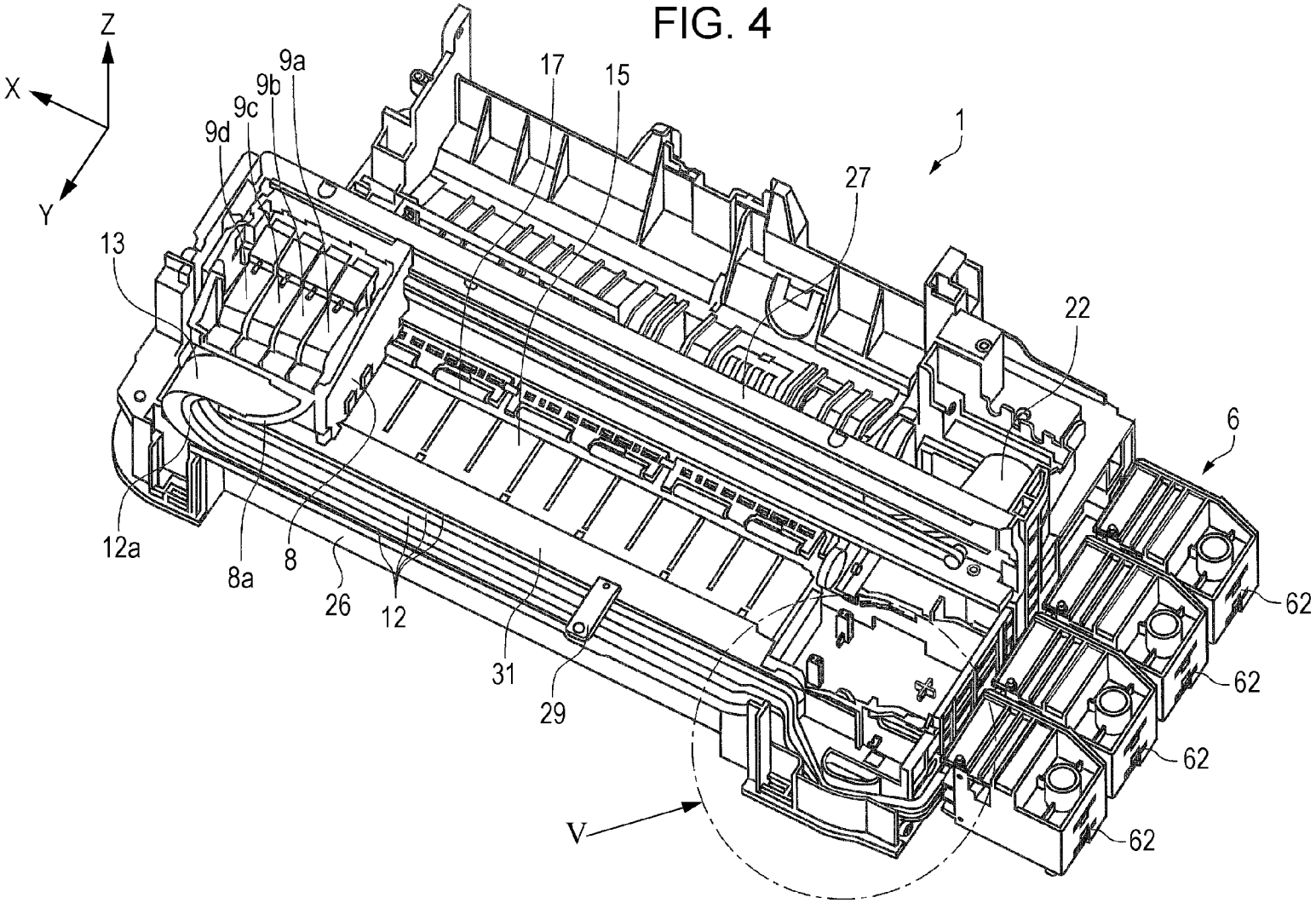
FIG. 4 is a perspective view illustrating the ink jet printer in a state where the case main body and the tank cover are removed.

FIGS. 3 and 4 are perspective views illustrating the printer 1 in a state where both the case main body 2 and the tank cover 61 are removed. A driving roller for transport 16 is rotationally driven by a motor (not illustrated). A driven roller for transport 17 is rotationally driven, in a state where a paper sheet is nipped between the driven roller for transport 17 and the driving roller for transport 16. A paper support member 15 is provided on a downstream side of the rollers. The paper support member 15 supports the paper sheet transported by both the driving roller for transport 16 and the driven roller for transport 17.

A carriage 8 receives a driving force from a driving motor 22 and reciprocates in the main scanning direction X, in a state where the carriage 8 is guided by a guide portion 27 extending in the main scanning direction X. A liquid ejecting head 10 is provided in the bottom portion of the carriage 8. The liquid ejecting head 10 reciprocates in the main scanning direction X, in accordance with reciprocation of the carriage 8.

A driving roller for discharge and a driven roller for discharge (not illustrated) are provided on the downstream side of an area (which is a recording area) in which the paper support member 15 and the liquid ejecting head 10 face each other. A paper sheet subjected to recording is discharged through the discharge opening portion 3 illustrated in FIG. 1, using the driving roller for discharge and the driven roller for discharge.

One end sides of the four liquid supply tubes 12 are fixed to the carriage 8 and the other end sides are connected to the ink tanks 62. The ink is supplied from the ink tanks 62 to the liquid ejecting head 10, through the liquid supply tubes 12.

Relay adapters 9*a*, 9*b*, 9*c*, and 9*d* are provided in the carriage 8, to correspond to the ink colors. The liquid supply tubes 12 are respectively connected to the relay adapters 9*a* to 9*d*. The ink is supplied to the liquid ejecting head 10, through the respective relay adapters 9*a* to 9*d*.

A tube extension portion 8*a* is formed in the front side of the carriage 8. A plurality of liquid supply tubes 12 extend, in parallel, from the tube extension portion 8*a* to the left side in FIGS. 3 and 4. In the middle portion, the liquid supply tubes 12 are bent to the right side in FIGS. 3 and 4 and extend, along the upper portion of the tube support portion 31, to the right side in FIGS. 3 and 4. The extended liquid supply tubes 12 reach the ink tanks 62.

The plurality of liquid supply tubes 12 are supported by the tube support portion 31. Parts of the liquid supply tubes 12 are fixed to the tube support portion 31, using a tube fixing member 29.

The liquid supply tubes 12 have flexibility. Thus, the liquid supply tubes 12 are deformed in accordance with reciprocation of the carriage 8. FIG. 3 illustrates a state where the carriage 8 is located in a home-position area arranged on the right side in the drawing. FIG. 4 illustrates a state where the carriage 8 is located at the most distant position from the home position on the left side in the drawing. The liquid supply tubes 12 are deformed in accordance with reciprocation of the carriage 8. Accordingly, the position of a bent portion (a curved portion) 12*a* is changed in accordance with reciprocation of the carriage 8.

A guide member 13 for guiding the liquid supply tubes 12 is provided along the liquid supply tubes 12. The guide member 13 is a sheet-shaped member having flexibility and can be formed of, for example, polyethylene terephthalate (PET). The guide member 13 is deformed in accordance with reciprocation of the carriage 8, similarly to the liquid supply tubes 12.

Since the guide member 13 is provided, when the liquid supply tubes 12 are deformed in accordance with the movement of the carriage 8, the posture of the liquid supply tubes 12 is stabilized. In addition, the guide member 13 is provided in a portion between the liquid supply tubes 12 and the tube support portion 31, and thus the liquid supply tubes 12 do not come into contact with the tube support portion 31. As a result, the liquid supply tubes 12 are prevented from becoming worn.

Figure 5:
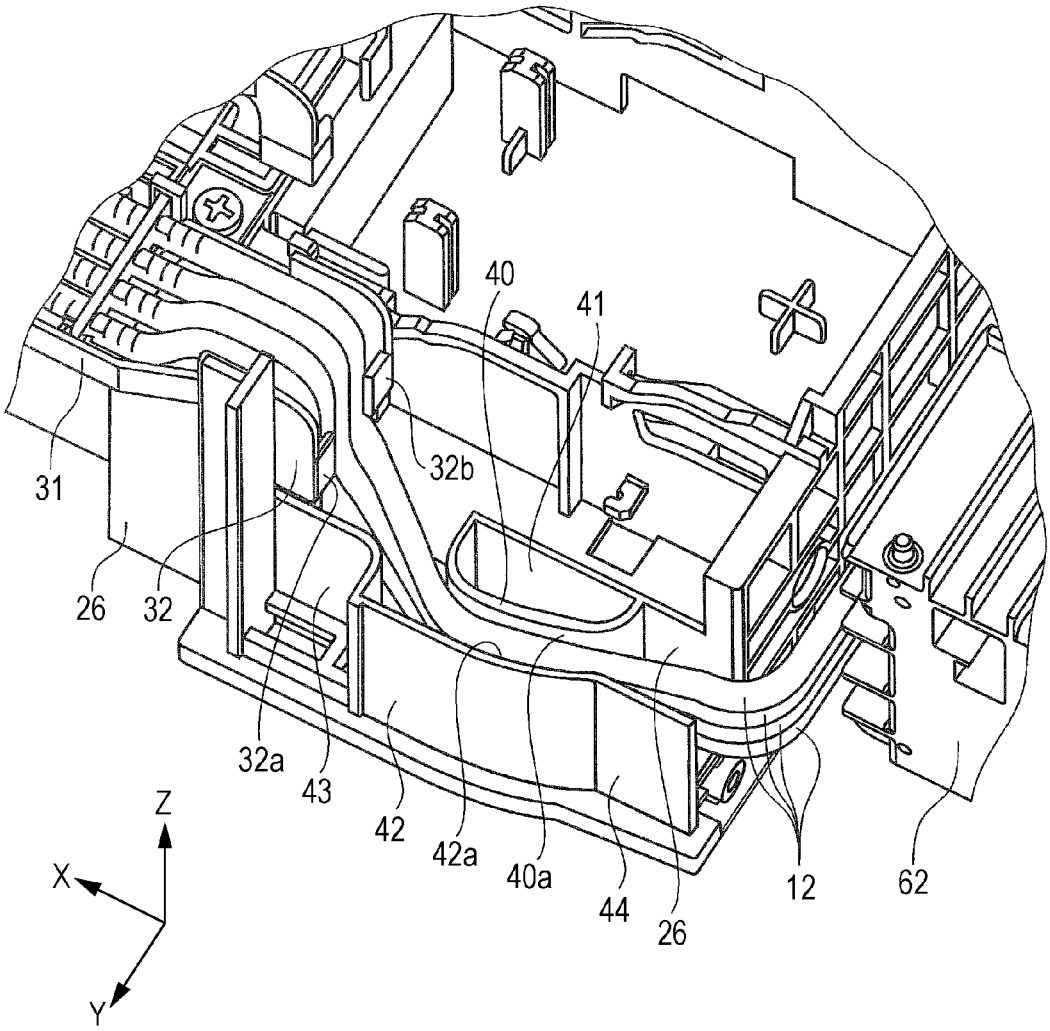
FIG. 5 is a perspective view illustrating a portion which changes a parallel alignment direction of liquid supply tubes, from a horizontal direction to a vertical direction.

FIG. 5 is an enlarged view of a portion in the circle illustrated by the one-dot chain line V in FIG. 4. In other words, FIG. 5 is a perspective view illustrating a portion which changes the parallel alignment direction of the four liquid supply tubes 12, from the horizontal direction to the vertical direction. A tube guide portion 32 is provided in the ink tank 62 side which is the right side of the tube support portion 31 in FIG. 5. The tube guide portion 32 guides the liquid supply tubes 12 such that the direction of the liquid supply tubes 12 changes to be directed downward. Tube holding portions 32*a* and 32*b* are provided in the tube guide portion 32 to regulate the movement of the liquid supply tubes 12.

An inner-side curved wall portion 40 is provided in the ink tanks 62 side of the tube guide portion 32. The inner-side curved wall portion 40 stands vertically upward from the bottom portion of a main body frame 26. A curved surface 40*a* is provided in the front side (which is a downstream side in the transporting direction Y) of the inner-side curved wall portion 40. The cross-sectional shape of the curved surface 40*a* protrudes to the front side, when viewed from the vertical direction Z.

A wall portion 41 is connected to the rear side (which is an upstream side in the transporting direction Y) of the inner-side curved wall portion 40. The wall portion 41 stands vertically upward from the bottom portion of the main body frame 26 and extends in the main scanning direction X. Accordingly, the inner-side curved wall portion 40 has increased rigidity.

An outer-side curved wall portion 42 is disposed ahead of the inner-side curved wall portion 40. The outer-side curved wall portion 42 stands vertically upward from the bottom portion of the main body frame 26. A curved surface 42*a* is provided in the rear side of the outer-side curved wall portion 42. The cross-sectional shape of the curved surface 42*a* protrudes to the front side, when viewed from the vertical direction Z.

A wall portion 43 which stands vertically upward from the bottom portion of the main body frame 26 is connected to the tube guide portion 32 side of the outer-side curved wall portion 42. A wall portion 44 which stands vertically upward from the bottom portion of the main body frame 26 is connected to the ink tanks 62 side of the outer-side curved wall portion 42. Accordingly, the outer-side curved wall portion 42 has increased rigidity.

The vertical position of the inner-side curved wall portion 40, the wall portion 41, the outer-side curved wall portion 42, the wall portion 43, or the wall portion 44 is lower than the position of the tube holding portions 32*a* and 32*b* of the tube guide portion 32.

The liquid supply tubes 12 extend downward so as to be directed from the position of the tube holding portions 32*a* and 32*b* to both the inner-side curved wall portion 40 and the outer-side curved wall portion 42. Furthermore, the liquid supply tubes 12 pass through the portion between the curved surface 40*a* and the curved surface 42*a* and extend outside through an opening between the wall portion 44 and the main body frame 26. The liquid supply tubes 12 extend, to the rear side, along the lateral portion of the main body frame 26, which is the lateral portion on the right side in FIG. 5.

The liquid supply tubes 12 are arranged along the curved surface 40*a* of the inner-side curved wall portion 40. The parallel alignment direction of the four liquid supply tubes 12 is the vertical direction Z. The outer-side curved wall portion 42 is disposed ahead of the inner-side curved wall portion 40 and the liquid supply tubes 12 are interposed between the outer-side curved wall portion 42 and the inner-side curved wall portion 40. As a result, the movement of the liquid supply tubes 12 can be regulated.

Figure 6:
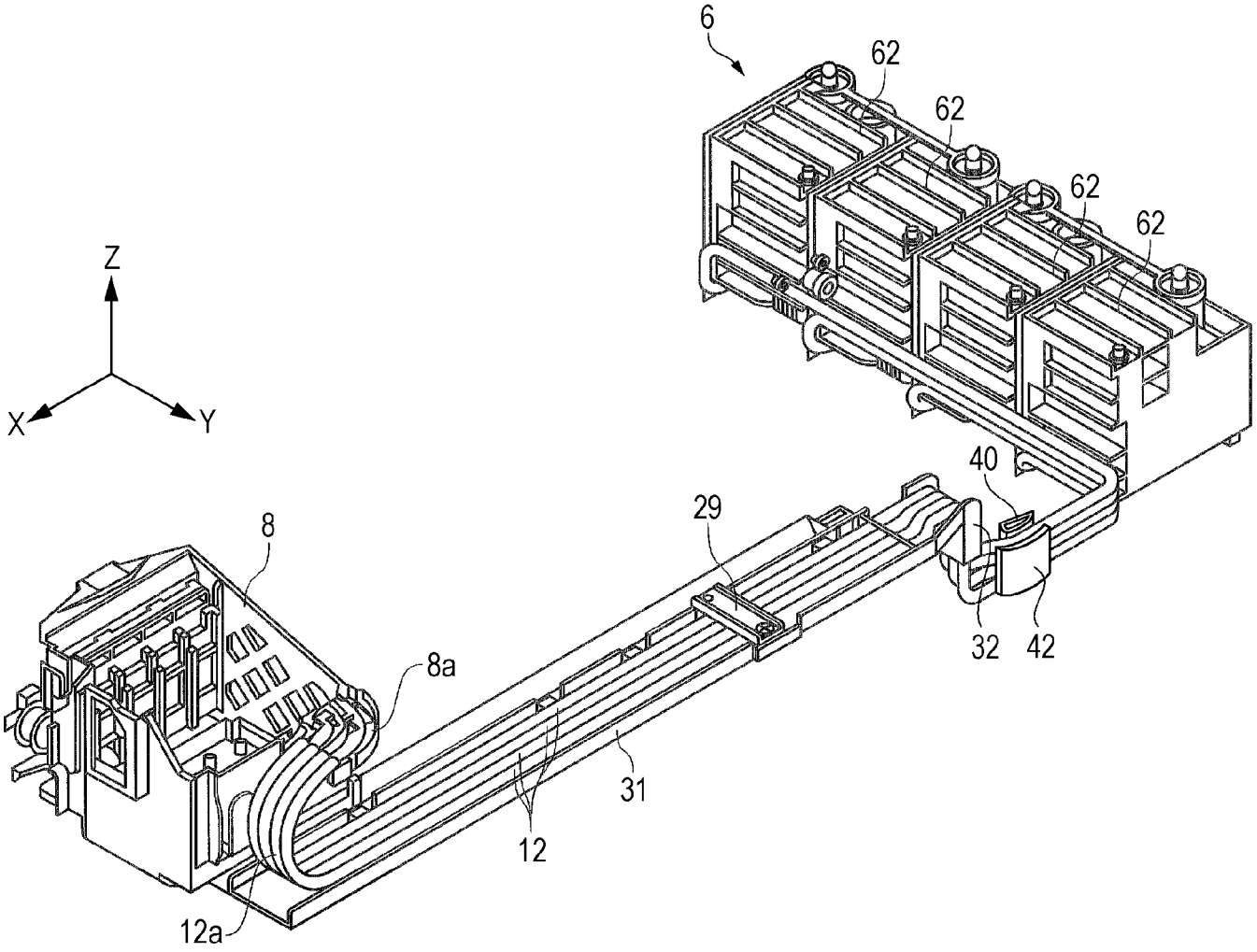
FIG. 6 is a perspective view illustrating the arrangement of the liquid supply tubes.

FIG. 6 is a perspective view illustrating a state where the tube support portion 31 is removed from the main body frame 26 illustrated in FIG. 4. The tube support portion 31 has a shape extending in the main scanning direction X. The entirety of the tube support portion 31 is integrally formed by resin molding. The tube support portion 31 is mounted on and fixed to the main body frame 26 constituting the base body of the printer 1. The mounted position of the tube support portion 31 in the transporting direction Y is located further to the downstream side than the carriage 8.

The four liquid supply tubes 12 are aligned in parallel, as illustrated in FIG. 6. One end portions of the liquid supply tubes 12 are connected to the tube extension portion 8*a* of the carriage 8 and the other ends are connected to the ink tanks 62. In the area in which the liquid supply tubes 12 are aligned along the tube support portion 31 and the tube guide portion 32, the parallel alignment direction of the liquid supply tubes 12 is the transporting direction Y, that is, the horizontal direction.

The parallel alignment direction of the liquid supply tubes 12 extending from the tube guide portion 32 changes gradually. In the area in which the liquid supply tubes 12 extend along the curved surface 40*a* of the inner-side curved wall portion 40, the parallel alignment direction of the four liquid supply tubes 12 changes to the vertical direction Z. In the area in which the liquid supply tubes 12 extend from the inner-side curved wall portion 40 to the ink tanks 62 side, the parallel alignment direction of the four liquid supply tubes 12 is maintained to be parallel to the vertical direction Z.

Figure 7:
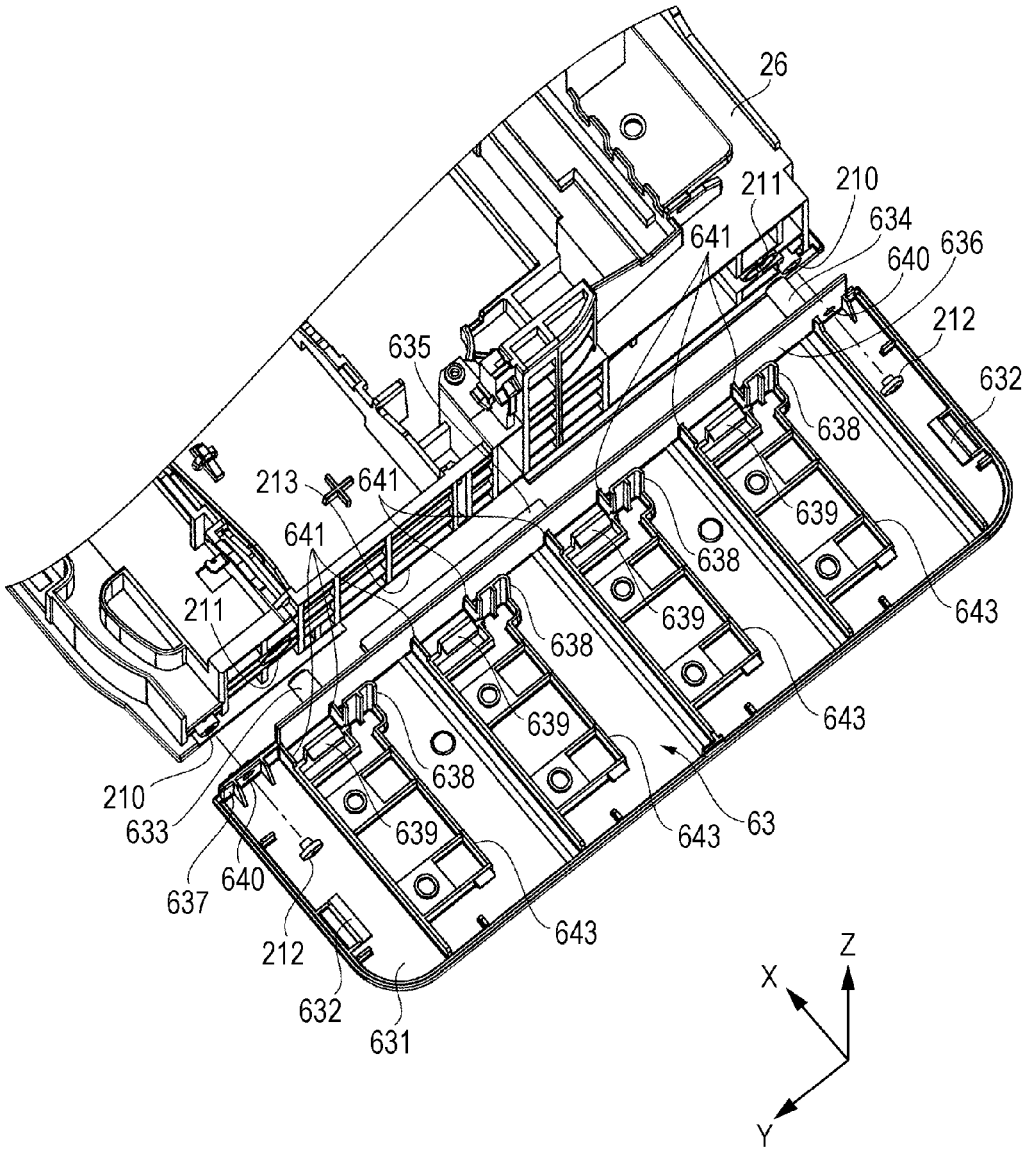
FIG. 7 is a perspective view illustrating a mounting portion.

FIG. 7 is a perspective view of the mounting portion 63 provided in the lateral portion of the main body frame 26. In the lateral portion of the main body frame 26, in which the tank unit 6 is mounted, concave portions 211 which have a cylindrical shape and are recessed inward are provided in the front side and the rear side.

Bosses 633 and 634 having a columnar shape protruding to the main body frame 26 side are provided on the front side and the rear side of the mounting portion 63. The bosses 633 and 634 are inserted into the concave portions 211 which have a cylindrical shape and are provided on the front side and the rear side of the printer 1. As a result, the position of the mounting portion 63 may be set with respect to the main body frame 26.

A concave portion 213 recessed upward is provided in the middle of the bottom portion of the lateral portion of the main body frame 26. A protrusion portion 635 is provided in the bottom portion of the mounting portion 63. The protrusion portion 635 having a plate shape protrudes to the main body frame 26 side. The cross-sectional shape of the protrusion portion 635 has a rectangular shape, when viewed from the main scanning direction X. The protrusion portion 635 is inserted into the concave portion 213. When the protrusion portion 635 is inserted into the concave portion 213, the upper surface portion of the protrusion portion 635 comes into contact with the lower surface portion of the concave portion 213, and thus the posture of the mounting portion 63 is stabilized.

A wall portion 636 is provided in the main body frame 26 side of the mounting portion 63. The wall portion 636 stands upward from the bottom wall 631 and extends in the transporting direction Y. A wall portion 637 is disposed further to the front side of in the liquid ejecting apparatus than the wall portion 636. The wall portion 637 stands upward from the bottom wall 631 and extends in the transporting direction Y. The height of the wall portion 637 is smaller than that of the wall portion 636.

Through-holes 640 are provided in the rear side of the wall portion 636 and wall portion 637. The mounting portion 63 is fixed to the main body frame 26, in such a manner that screws 212 pass through the through-holes 640 and are screwed into screw holes 210 in the front side and the rear side of the lateral portion of the main body frame 26.

A plurality of engaging portions 639 are provided in the mounting portion 63. Each engaging portion 639 stands upward from the bottom wall 631 and can engage with the bottom portion of the ink tanks 62.

A plurality of standing portions 638 are provided in the mounting portion 63. Each standing portion 638 has a surface facing the surface of the wall portion 636 and stands upward from the bottom wall 631. In addition, a plurality of ribs 641 are provided in the mounting portion 63. Each rib 641 stands upward and extends in the main scanning direction X. The height of the rib 641 from the bottom wall 631 is lower than that of the wall portion 636 or the standing portion 638.

Figure 8:
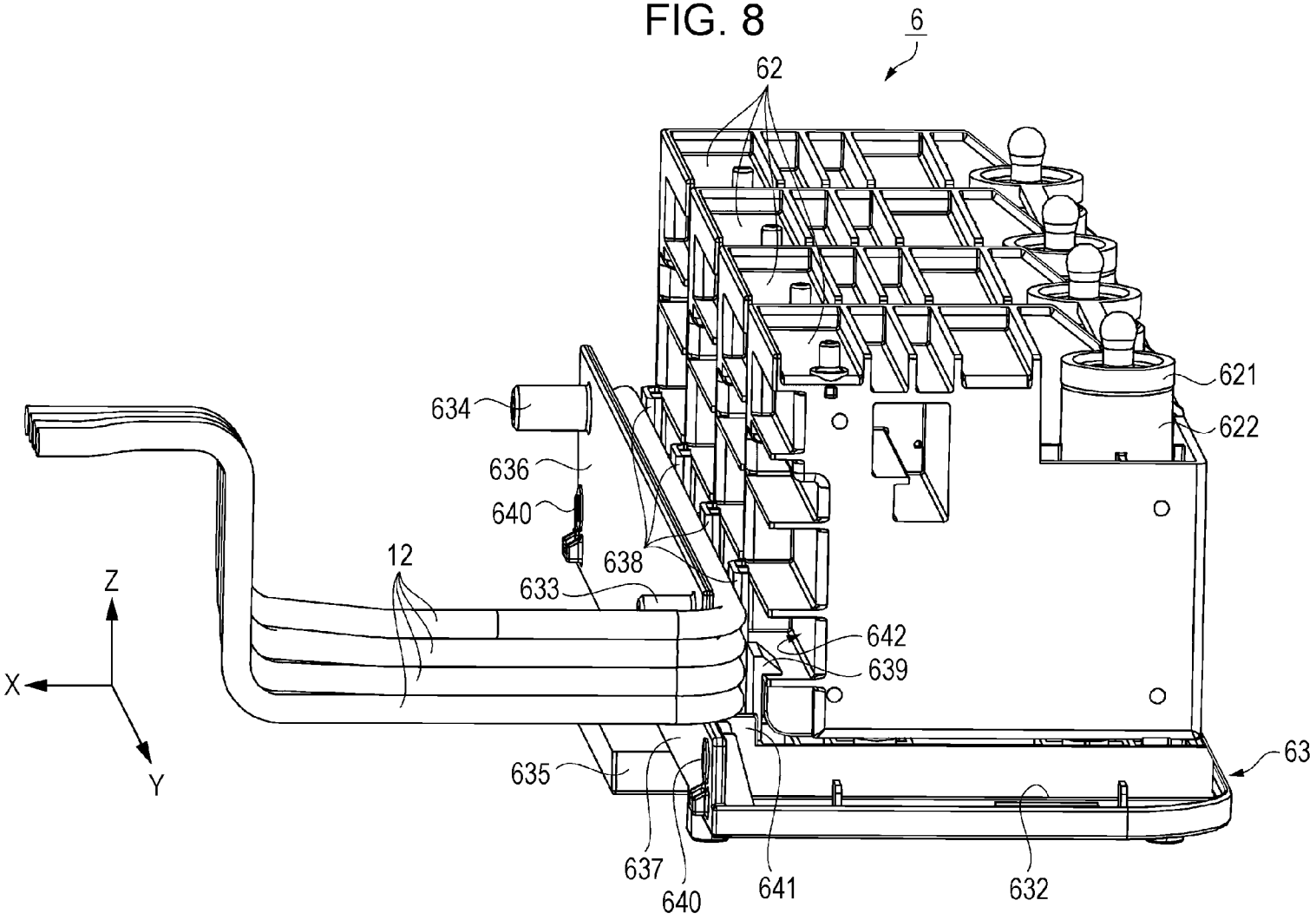
FIG. 8 is a perspective view of a state in which ink tanks are mounted on the mounting portion.

FIG. 8 is a perspective view of a state where the ink tanks 62 is mounted on the mounting portion 63. The respective ink tanks 62 are fixed to the mounting portion 63, using the engaging portions 639 illustrated in FIGS. 7 and 8. In the four liquid supply tubes 12 aligned in the vertical direction Z in parallel, the liquid supply tube 12 on the lowermost side abuts on and is supported by the wall portion 637.

The liquid supply tubes 12 extending in the transporting direction Y pass through the portion between the wall portion 636 and the standing portion 638. The liquid supply tubes 12 are supported by the ribs 641 illustrated in FIG. 7, and thus the position of the liquid supply tubes 12 in the vertical direction Z is set.

Figure 9A:
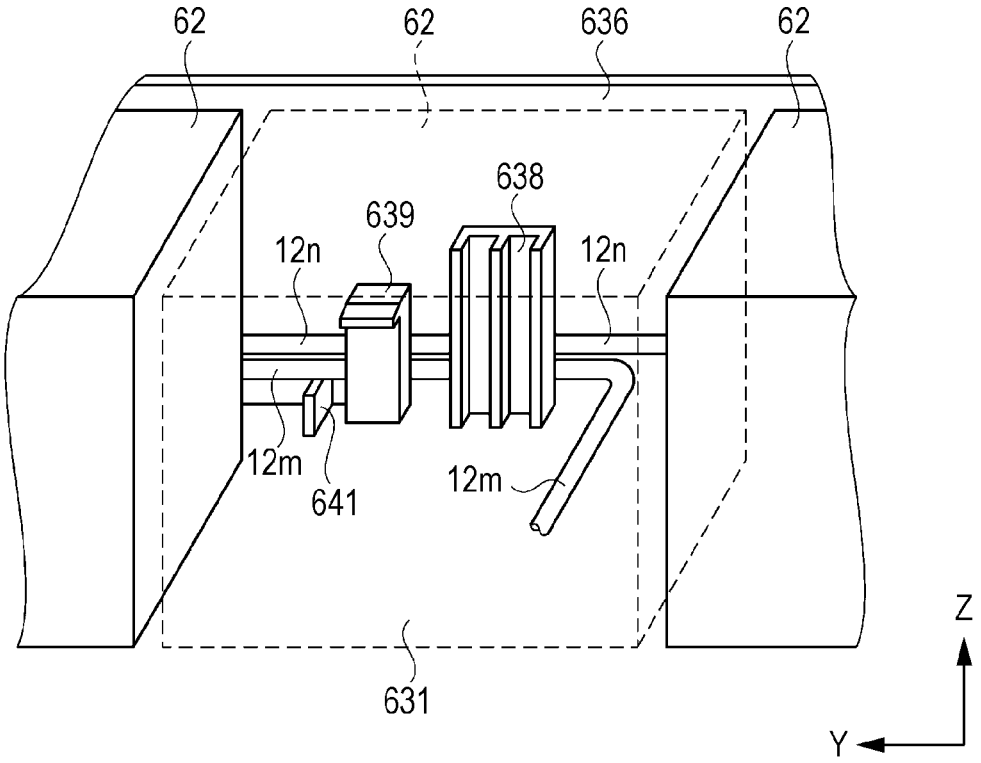
FIG. 9A is a perspective view illustrating a state where one ink tank is removed from the mounting portion and FIG. 9B is a perspective view seen from a bottom side of the ink tank.

FIG. 9A illustrates three ink tanks 62 arranged on the rear side, out of the four ink tanks 62 which are fixed to the mounting portion 63 of FIG. 8 and are aligned in the transporting direction Y. FIG. 9A is a perspective view of the ink tanks 62 in a state where one ink tank 62 illustrated by the broken line is removed, when viewed from the side opposite to the main body frame 26. The ribs 643 provided in the bottom wall 631 illustrated in FIG. 7 are not illustrated in FIG. 9A. The ink tanks 62 are respectively mounted on the ribs 643 and the bottom portions of the ink tanks 62 respectively engage with the engaging portions 639 illustrated in FIGS. 7 and 8.

Figure 9B:
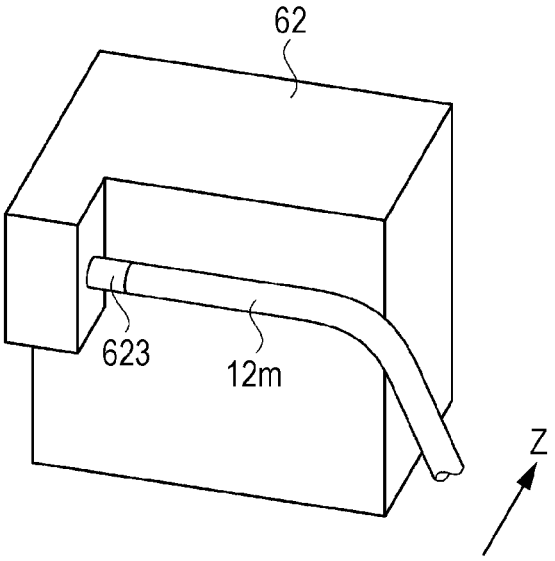

FIG. 9B is a perspective view of the ink tank 62, when viewed from the bottom side thereof. Liquid supply tubes 12*m* and 12*n* pass through the portion between the wall portion 636 and the standing portion 638 and the liquid supply tubes 12*m* and 12*n* are mounted on the ribs 641. The direction of the liquid supply tube 12*m* extending in the transporting direction Y changes on the rear side of the standing portion 638. Next, the liquid supply tube 12*m* passes through a gap between the ink tank 62 and the bottom wall 631, which is formed below the ink tanks 62. Then, the liquid supply tube 12*m* is connected to a connection portion 623 in the bottom portion of the ink tank 62 illustrated in FIG. 9B.

Similarly, the direction of each liquid supply tube 12 changes on the rear side of each standing portion 638 illustrated in FIG. 7. Next, the liquid supply tube 12 passes through a gap between the ink tank 62 and the bottom wall 631, which is formed below each ink tank 62. Then, the liquid supply tube 12 is connected to the connection portion 623 in the bottom portion of the ink tank 62.

The printer 1 illustrated in FIG. 3, which is described in the above embodiment, includes the carriage 8 which reciprocates with the liquid ejecting head 10 for ejecting ink as liquid, the tank unit 6 as a liquid accommodation portion for accommodating ink, the four liquid supply tubes 12 which communicate with both the liquid ejecting head 10 and the tank unit 6 and allow ink to be supplied from the tank unit 6 to the liquid ejecting head 10, the tube support portion 31 which supports the liquid supply tubes 12 in a state where the liquid supply tubes 12 are aligned, on the tube support portion 31, in the horizontal direction (the transporting direction Y) in parallel, and the case main body 2 as a case for accommodating both the carriage 8 and the tube support portion 31.

In the case main body 2, the four liquid supply tubes 12 extend further to the tank unit 6 side than a portion in which the four liquid supply tubes 12 are supported by the tube support portion 31, in a state where the parallel alignment direction of the four liquid supply tubes 12 changes from the horizontal direction (the transporting direction Y) to the vertical direction Z, as illustrated in FIG. 5.

According to this configuration, it is possible to reduce the length of a spatial area in the transporting direction Y, which is provided in the case main body 2 to allow the liquid supply tubes 12 to be disposed therein. As a result, the case main body 2 can be prevented from increasing in size.

The inner-side curved wall portion 40 is provided in a portion located further to the upstream side in a supply direction than the portion in which the liquid supply tubes 12 are supported by the tube support portion 31 illustrated in FIG. 5. The inner-side curved wall portion 40 stands in the vertical direction Z and functions as a curved wall portion of which the cross-sectional shape is curved, when viewed from the vertical direction Z. The parallel alignment direction of the four liquid supply tubes 12 is changed, by the inner-side curved wall portion 40, from the transporting direction Y to the vertical direction Z.

In this case, the liquid supply tubes 12 can extend along the inner-side curved wall portion 40. Thus, the four liquid supply tubes 12 can be aligned in the vertical direction Z in parallel. In addition, the extending direction of the liquid supply tubes 12 can be changed along the curved shape of the curved surface 40*a* and the liquid supply tubes 12 can be prevented from being damaged.

Both the inner-side curved wall portion 40 and the outer-side curved wall portion 42 are disposed, in the vertical direction Z, below a portion in which the liquid supply tubes 12 are supported by the tube support portion 31. The liquid supply tubes 12 extend downward in the vertical direction Z so as to be directed from the tube support portion 31 to the inner-side curved wall portion 40.

In this case, it is possible to reduce the height of a part of the case main body 2, in which the inner-side curved wall portion 40 and the outer-side curved wall portion 42 are provided.

The main body frame 26 is provided in the case main body 2. The tank unit 6 illustrated in FIG. 2A has the ink tanks 62 as a storage portion for storing ink, the tank cover 61 for accommodating the ink tanks 62, and the mounting portion 63 which is mounted on the main body frame 26, in a state where the mounting portion 63 supports both the ink tanks 62 and the tank cover 61. The tank unit 6 is disposed outside the case main body 2. Furthermore, the ribs 641 are provided in the mounting portion 63 illustrated in FIG. 7. The ribs 641 stand from the bottom wall 631 and the liquid supply tubes 12 are mounted on the ribs 641.

In this case, the liquid supply tubes 12 in the mounting portion 63 can be supported from below in the vertical direction Z.

In addition, the tube holding portion is provided in the mounting portion 63. The tube holding portion allows the liquid supply tubes 12 to be held in the portion between the main body frame 26 and the ink tanks 62, in a state where the liquid supply tubes 12 extend in the transporting direction Y. The tube holding portion is constituted by the wall portion 636 and the standing portions 638 illustrated in FIGS. 7 and 8.

According to this configuration, the liquid supply tubes 12 can be disposed in a state where the liquid supply tubes 12 linearly extend along lateral portions 642 of the ink tanks 62. Accordingly, the liquid supply tubes 12 can be prevented from being disposed in a curved state, and thus it is possible to reduce the distance between the case main body 2 and the ink tanks 62. As a result, the installation area of both the case main body 2 and the ink tanks 62 can be reduced.

The bosses 633 and 634 as a protrusion portion and the through-holes 640 as a first through-hole are provided in the mounting portion 63. The concave portions 211 and the screw holes 210 as a first screw hole are provided in the main body frame 26. The position of the mounting portion 63 is set with respect to the main body frame 26, in such a manner that the bosses 633 and 634 are inserted into the concave portions 211. Furthermore, the mounting portion 63 is fixed to the main body frame 26, in such a manner that the screws 212 passing through the through-holes 640 are screwed into the screw holes 210.

Accordingly, the mounting portion 63 can be fixed to the main body frame 26.

The engaging portion 632 having the protrusion portion 632*b* formed in the tip end portion is provided in the mounting portion 63 illustrated in FIG. 2A. The screw holes 201 as a second screw hole are provided in the case main body 2. The stepped portion 613*a* as an engaged portion engaging with the protrusion portion 632*b* and the through-holes 614 as a second through-hole are provided in the tank cover 61. The tank cover 61 is fixed to the mounting portion 63, in such a manner that the engaging portion 632 engages with the stepped portion 613*a*. The tank cover 61 is fixed to the case main body 2, in such a manner that the screws 202 passing through the through-holes 614 are screwed into the screw holes 201.

Accordingly, the tank cover 61 can be fixed to both the mounting portion 63 and the case main body 2.

Furthermore, the opening portion 611 is provided in the tank cover 61 to allow ink to be poured therethrough.

In this case, a user can pour ink into the ink tanks 62, without opening the tank cover 61. Accordingly, it is not necessary to provide, outside the tank cover 61, a spatial area to allow the tank cover 61 to be pivoted or slid, to open the tank cover 61.

Figure 10A:
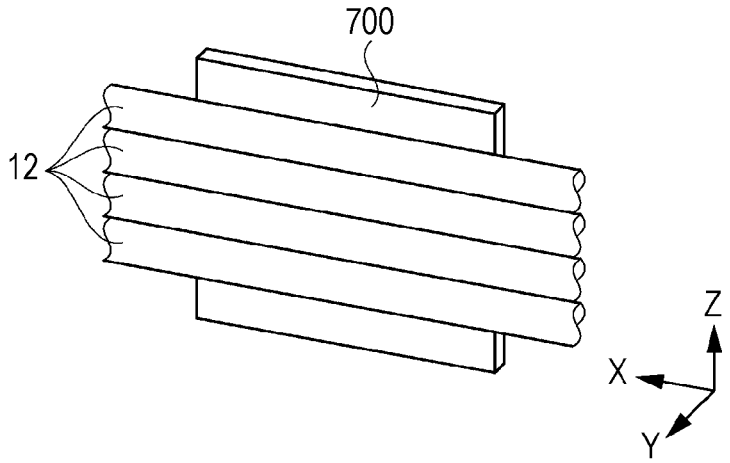
FIGS. 10A to 10C are perspective views illustrating members which change the parallel alignment direction of a plurality of liquid supply tubes, from the horizontal direction to the vertical direction.
Figure 10B:
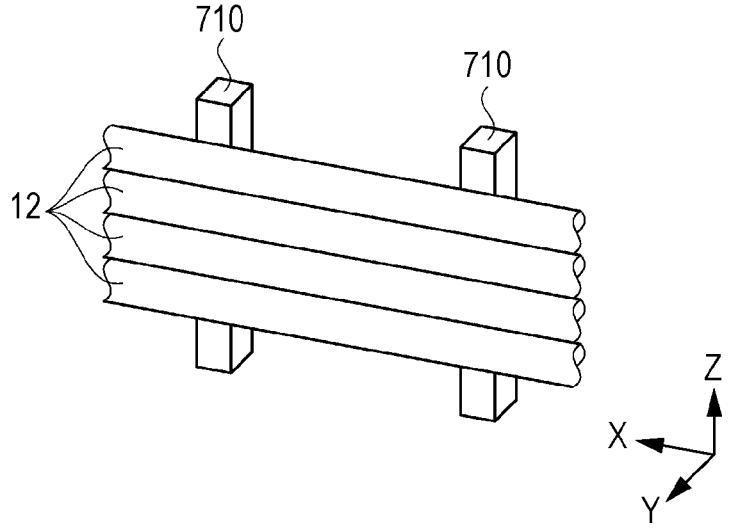
Figure 10C:
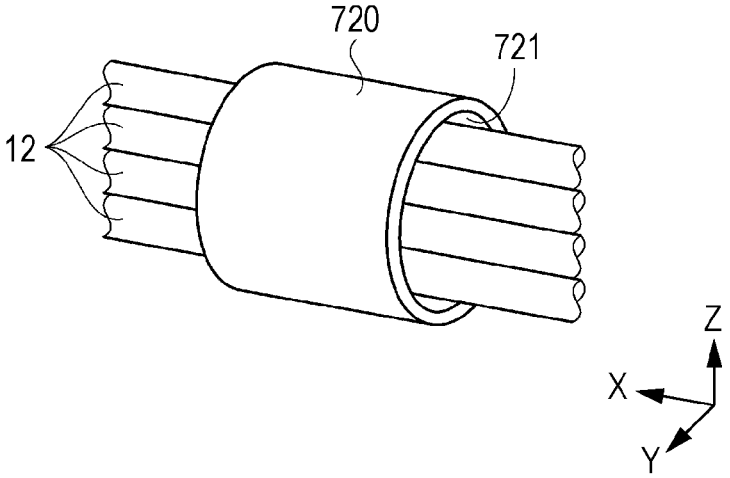

FIGS. 10A to 10C are perspective views illustrating members which change the parallel alignment direction of the plurality of liquid supply tubes 12, from the horizontal direction to the vertical direction. In this embodiment, the inner-side curved wall portion 40 changes the parallel alignment direction of the liquid supply tubes 12, from the horizontal direction to the vertical direction Z. However, the parallel alignment direction of the liquid supply tubes 12 may be changed from the horizontal direction to the vertical direction Z, in such a manner that a wall portion 700 having a plate shape extending in the main scanning direction X is provided and the plurality of liquid supply tubes 12 are arranged along the wall portion 700, as illustrated in FIG. 10A.

The parallel alignment direction of the liquid supply tubes 12 may be changed from the horizontal direction to the vertical direction Z, in such a manner that at least a columnar-shaped member 710 is provided and the plurality of liquid supply tubes 12 abut on and are arranged along the columnar-shaped member 710, as illustrated in FIG. 10B.

The parallel alignment direction of the liquid supply tubes 12 may be changed from the horizontal direction to the vertical direction Z, in such a manner that a cylindrical-shaped member 720 having a hollow portion 721 of which the shape viewed from the main scanning direction X is elliptical is provided and the plurality of liquid supply tubes 12 are arranged passing through the hollow portion 721, as illustrated in FIG. 10C.

The parallel alignment direction of the plurality of liquid supply tubes 12 may be changed from the horizontal direction to the vertical direction Z, in such a manner that the opening portion in the lateral surface 2*a* of the case main body 2 is formed in a shape extending in the vertical direction Z and the plurality of liquid supply tubes 12 passes through the opening portion.

The liquid supply tubes 12 extend outside through the opening portion between the wall portion 44 and the main body frame 26. The liquid supply tubes 12 passing through the opening portion may branch off to both the front side and the rear side.

The entire disclosure of Japanese Patent Application No. 2013-262146, filed Dec. 19, 2013 is expressly incorporated by reference herein.

What is claimed is:

1. A liquid ejecting apparatus comprising:

a carriage which reciprocates in a state where a liquid ejecting head for ejecting liquid is mounted thereon;

liquid accommodation portions which accommodate the liquid;

a plurality of liquid supply tubes which communicate with the liquid ejecting head and the liquid accommodation portions and supply the liquid from the liquid accommodation portions to the liquid ejecting head;

a tube support portion which supports the plurality of liquid supply tubes in a state where the liquid supply tubes are aligned in a horizontal direction; and a case which accommodates the carriage and the tube support portion, wherein a plurality of the liquid accommodation portions are arranged in the lateral side of the case, and wherein, in the case, the plurality of liquid supply tubes extend further to the liquid accommodation portion side than a portion in which the liquid supply tubes are supported by the tube support portion, in a state where a parallel alignment direction of the plurality of liquid supply tubes changes from the horizontal direction to a vertical direction such that the liquid supply tubes extend in an alignment direction of the plurality of liquid accommodation portions, wherein the plurality of liquid supply tubes are arranged between the side of the housing and the liquid accommodation portions from front to rear, and connected to a bottom area of the liquid accommodation portions.

2. The liquid ejecting apparatus according to claim 1, further comprising:

a curved wall portion which stands in the vertical direction and has a curved cross-sectional shape, when viewed from the vertical direction, wherein the curved wall portion changes the parallel alignment direction of the plurality of liquid supply tubes, from the horizontal direction to the vertical direction.

3. The liquid ejecting apparatus according to claim 2, wherein the curved wall portion has a curved surface and the curved surface is located further to the front side of the case than the central position of the tube support portion in the parallel alignment direction of the liquid supply tubes.

4. The liquid ejecting apparatus according to claim 2, wherein the liquid supply tube is disposed in a portion between the curved wall portion and an inner wall portion of the case.

5. A liquid ejecting apparatus comprising:

a carriage which reciprocates in a state where a liquid ejecting head for ejecting liquid is mounted thereon;

a liquid accommodation portion which accommodates the liquid;

a plurality of liquid supply tubes which communicate with the liquid ejecting head and the liquid accommodation portion and supply the liquid from the liquid accommodation portion to the liquid ejecting head;

a tube support portion which supports the plurality of liquid supply tubes in a state where the liquid supply tubes are aligned in a horizontal direction; and a case which accommodates the carriage and the tube support portion, wherein a main body frame is provided in the case, wherein the liquid accommodation portion has a storage portion for storing the liquid, a tank cover for accommodating the storage portion, and a mounting portion which is mounted on the main body frame, in a state where the mounting portion supports the storage portion and the tank cover, and wherein a rib is provided in the mounting portion to support the liquid supply tubes, wherein, in the case, the plurality of liquid supply tubes extend further to the liquid accommodation portion side than a portion in which the liquid supply tubes are supported by the tube support portion, in a state where a parallel alignment direction of the plurality of liquid supply tubes changes from the horizontal direction to a vertical direction such that the liquid supply tubes extend in an alignment direction of the plurality of liquid accommodation portion, wherein the plurality of liquid supply tubes are arranged between the side of the housing and the liquid accommodation portions from front to rear, and connected to a bottom area of the liquid accommodation portions.

6. The liquid ejecting apparatus according to claim 5, wherein a tube holding portion is provided in the mounting portion to allow the liquid supply tubes to be held in a portion between the main body frame and the storage portion, in a state where the liquid supply tubes are stretched.

7. The liquid ejecting apparatus according to claim 5, wherein a protrusion portion and a first through-hole are provided in the mounting portion, wherein a concave portion and a first screw hole are provided in the main body frame, wherein the protrusion portion is inserted into the concave portion and the position of the mounting portion is set with respect to the main body frame, and wherein a screw passing through the first through-hole is screwed into the first screw hole and the mounting portion is fixed to the main body frame.

8. The liquid ejecting apparatus according to claim 5, wherein an engaging portion having a protrusion portion formed in a tip end portion is provided in the mounting portion, wherein a second screw hole is provided in the case, wherein an engaged portion engaging with the protrusion portion and a second through-hole are provided in the tank cover, wherein the engaging portion engages with the engaged portion and the tank cover is fixed to the mounting portion, and wherein a screw passing through the second through-hole is screwed into the second screw hole and the tank cover is fixed to the case.

9. The liquid ejecting apparatus according to claim 1, wherein an opening portion is provided in the tank cover to allow liquid to be poured therethrough.

* * * * *